US011642901B2

(12) United States Patent
Goto et al.

(10) Patent No.: US 11,642,901 B2
(45) Date of Patent: May 9, 2023

(54) PRINTING APPARATUS AND PRINTING METHOD

(71) Applicant: SEIKO EPSON CORPORATION, Tokyo (JP)

(72) Inventors: Atsushi Goto, Nagano (JP); Masaya Usui, Nagano (JP); Yasutoshi Takeuchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/410,036

(22) Filed: Aug. 24, 2021

(65) Prior Publication Data

US 2022/0063312 A1 Mar. 3, 2022

(30) Foreign Application Priority Data

Aug. 26, 2020 (JP) ..... JP2020-142416

(51) Int. Cl.
*B41J 2/07* (2006.01)
*B41J 19/14* (2006.01)
*B41J 25/00* (2006.01)

(52) U.S. Cl.
CPC ..... *B41J 25/006* (2013.01); *B41J 2/07* (2013.01); *B41J 19/142* (2013.01)

(58) Field of Classification Search
CPC ..... B41J 25/006; B41J 2/07; B41J 19/142
See application file for complete search history.

(56) References Cited

U.S. PATENT DOCUMENTS 5,369,428 A * 11/1994 Maze ..... B41J 2/5056 400/323
2006/0033772 A1* 2/2006 Yakubov ..... B41J 11/46 347/41
2009/0058895 A1* 3/2009 Kida ..... B41J 25/308 347/8
2012/0133720 A1 5/2012 Sato
2020/0031117 A1* 1/2020 Kaiba ..... B41J 2/04516

FOREIGN PATENT DOCUMENTS

JP 2005-047168 A 2/2005
JP 2012-116083 A 6/2012

* cited by examiner

*Primary Examiner* — Yaovi M Ameh
(74) *Attorney, Agent, or Firm* — Global IP Counselors, LLP

(57) ABSTRACT

A printing apparatus includes a head configured to discharge liquid to a printing medium, a carriage configured to move the head back and forth to one side and another side in a scanning direction with respect to the printing medium, and a control unit configured to perform printing of a printing image with the liquid by controlling driving of the head and the carriage. When performing printing of an end portion of the printing image on the one side, the control unit performs the printing by a first scan in which the head is moved from the one side to the other side, and when performing printing of an end portion of the printing image on the other side, the control unit performs the printing by a second scan in which the head is moved from the other side to the one side.

5 Claims, 8 Drawing Sheets

KNOWN TECHNOLOGY

KNOWN TECHNOLOGY

PRINTING APPARATUS AND PRINTING METHOD

The present application is based on, and claims priority from JP Application Serial Number 2020-142416, filed Aug. 26, 2020, the disclosure of which is hereby incorporated by reference herein in its entirety.

BACKGROUND

1. Technical Field

The present invention relates to a printing apparatus that performs printing by discharging liquid, and a printing method.

2. Related Art

An ink-jet printer of a serial head type forms an image on a printing medium by forming, in a conveyance direction, dots aligned in a scanning direction by alternately repeating a path operation of discharging ink drops while moving a head that discharges ink drops back and forth in the scanning direction with respect to the printing medium and a conveyance operation of moving the printing medium in the conveyance direction that intersects the scanning direction. At this time, a phenomenon may occur in which the impinging position of the dot discharged to a corresponding predetermined position in the scanning of the head in the forward direction and the impinging position of the dot discharged to a corresponding predetermined position in the scan in the return direction are shifted from each other. For example, when information about a code such as a bar code is printed with the above-mentioned deviation of the impinging positions of the dots, the sizes of the elements constituting the code may vary and their shapes may be distorted, resulting in reduction in the quality of the code. Low quality codes may cause read failures when reading the code information.

In view of this, JP-A-2005-47168 discloses an ink-jet printer that suppresses the reduction of the code quality caused by a deviation of the impinging positions due to the difference in the scanning direction by confirming whether information about a code such as a bar code is included in data to be printed in the next scan such that one-direction printing is performed when the code information is included whereas bidirectional printing is performed when the code information is not included.

However, in an ink-jet printer, the ink drop discharged by the head may split into a main drop and one or more satellite drops following the main drop at the time when or immediately after it is discharged. The impinging of the satellite drop is delayed compared to the impinging of the main drop, and therefore the impinging positions are shifted in the scanning direction in an ink-jet printer of a serial head type that discharges ink drops while moving the head back and forth in the scanning direction. The same applies to the printing apparatus disclosed in JP-A-2005-47168, and therefore, even in the case where printing of a region including code information is performed in one-direction printing, the impinging position of the satellite drop is shifted from the impinging position of the main drop. Consequently, the code quality may be reduced due to variation of the sizes of elements constituting a bar code and distortion of shapes, for example.

SUMMARY

A printing apparatus of an embodiment of the present invention includes a head configured to discharge liquid to a printing medium, a carriage configured to move the head back and forth to one side and another side in a scanning direction with respect to the printing medium, and a control unit configured to perform printing of a printing image with the liquid by controlling driving of the head and the carriage. When performing printing of an end portion of the printing image on the one side, the control unit performs the printing by a first scan in which the head is moved from the one side to the other side, and when performing printing of an end portion of the printing image on the other side, the control unit performs the printing by a second scan in which the head is moved from the other side to the one side.

A printing method of an embodiment of the present invention is a method of performing printing of a printing image in a printing apparatus including a head configured to discharge liquid to a printing medium, and a carriage configured to move the head back and forth to one side and another side in a scanning direction with respect to the printing medium, the method including performing the printing by a first scan in which the head is moved from the one side to the other side when performing printing of an end portion of the printing image on the one side, and performing the printing by a second scan in which the head is moved from the other side to the one side when performing printing of an end portion of the printing image on the other side.

DESCRIPTION OF EXEMPLARY EMBODIMENTS

Figure 1:
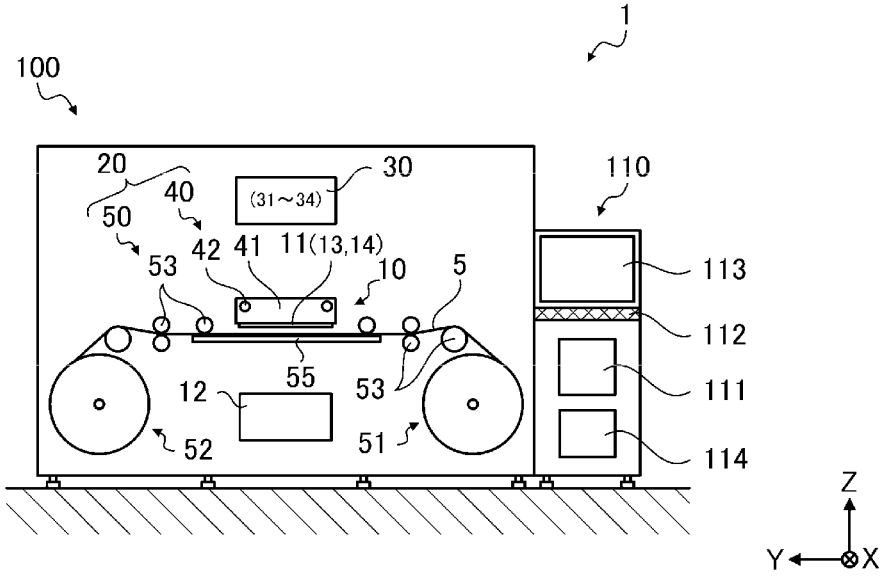
FIG. 1 is a front view illustrating a configuration of a printing apparatus according to an embodiment.
Figure 2:
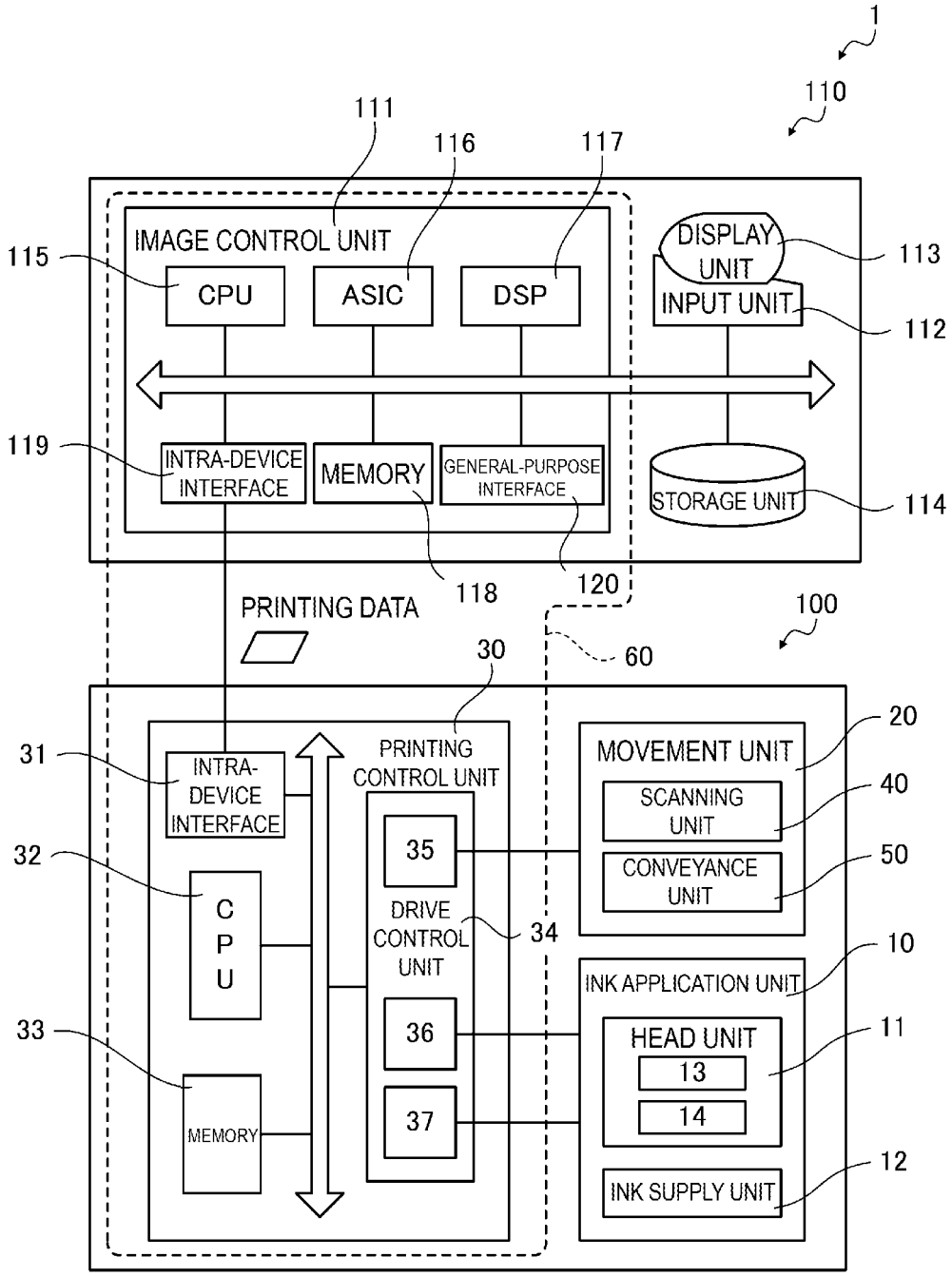
FIG. 2 is a block diagram illustrating a configuration of the printing apparatus according to the embodiment.

A configuration of a printing apparatus 1 according to the present embodiment is described below with reference to FIG. 1 and FIG. 2.

Note that in the coordinates in the drawings, the Z-axis direction is the vertical direction, the +Z direction is the upward direction, the X-axis direction is the front-rear direction, the −X direction is the front direction, the Y-axis direction is the horizontal direction, the +Y direction is the left direction, and the X-Y plane is the horizontal surface.

The printing apparatus 1 is composed of a printing unit 100, and an image processing unit 110 connected to the printing unit 100.

The printing unit 100 is an ink-jet printer that performs printing of a desired image by applying ink as liquid to a long printing medium 5 set in a rolled state on the basis of printing data received from the image processing unit 110.

The image processing unit 110 includes an image control unit 111, an input unit 112, a display unit 113, a storage unit 114, and the like, and controls a printing job of causing the printing unit 100 to perform printing. In addition, the image processing unit 110 generates printing data for causing the printing unit 100 to execute printing of a desired image based on image data. As a preferable example, the image processing unit 110 is configured with a personal computer.

The software for operating the image processing unit 110 includes generally used image processing application software that handles image data to be printed, printer driver software that generates printing data for control of the printing unit 100 and execution of printing of the printing unit 100, and a color conversion look-up table creation program that creates a color conversion look-up table required for generation of printing data. In the following description, the image processing application software is simply referred to as an image processing application, and the printer driver software is simply referred to as a printer driver.

Here, the image data is code information of a bar code or the like, or RGB digital image information including a line drawing and text data.

The image control unit 111 includes a CPU 115, an ASIC 116, a DSP 117, a memory 118, an intra-device interface 119, a general-purpose interface 120 and the like, and performs centralized management of the entire printing apparatus 1. CPU stands for Central Processing Unit, ASIC stands for Application Specific Integrated Circuit, and DSP stands for Digital Signal Processor. The input unit 112 is an information input means serving as a user interface. More specifically, it is a keyboard, a mouse pointer, and the like, for example.

The display unit 113 is an information display means serving as a user interface, and displays information input from the input unit 112, a printing image of the printing unit 100, information related to a printing job and the like under the control of the image control unit 111.

The storage unit 114 is a rewritable storage medium such as a hard disk drive or a memory card, and stores a program to be operated by the image control unit 111 as software for operating the image processing unit 110, information related to a printing image and a printing job, and the like.

The memory 118 is a storage medium that secures a region for storing a program to be executed by the CPU 115 and a working region of an operation and the like, and is composed of a memory element such as a RAM and an EEPROM. RAM stands for Random Access Memory, and EEPROM stands for Electrically Erasable Programmable Read-Only Memory.

The general-purpose interface 120 is an interface capable of connecting external electronic apparatuses such as a LAN interface or a USB interface. LAN stands for Local Area Network, and USB stands for Universal Serial Bus. In the present embodiment, the general-purpose interface 120 is a data acquisition unit that acquires image data from an external electronic apparatus under the control of the CPU 115.

The printing unit 100 is composed of an ink application unit 10, a movement unit 20, a printing control unit 30 and the like. When the printing unit 100 receives printing data from the image processing unit 110, the printing unit 100 controls the ink application unit 10 and the movement unit 20 by the printing control unit 30 and performs printing of an image on the printing medium 5 on the basis of the printing data.

The printing data is data for image formation obtained through conversion and processing of image data such that the data can be printed by the printing unit 100 with the image processing application and the printer driver of the image processing unit 110, and the printing data includes a command for controlling the printing unit 100.

The ink application unit 10 is composed of a head unit 11, an ink supply unit 12 and the like.

The movement unit 20 is composed of a scanning unit 40, a conveyance unit 50 and the like.

The scanning unit 40 is composed of a carriage 41, a guide shaft 42, a carriage motor, and the like. Illustration of the carriage motor is omitted.

The conveyance unit 50 is composed of a supply unit 51, a housing unit 52, a conveyance roller 53, a platen 55, and the like.

The head unit 11 includes a head 13 including a plurality of nozzles that discharge ink for printing in the form of an ink drop and a head control unit 14. The head unit 11 is mounted in the carriage 41, that is, the head 13 is mounted in the carriage 41, and moves back and forth in the X-axis direction along with the carriage 41 that moves in the X-axis direction as the scanning direction.

As the ink, a four-color ink set including black ink in addition to the three-color ink set of cyan, magenta, and yellow is used.

Figure 3:
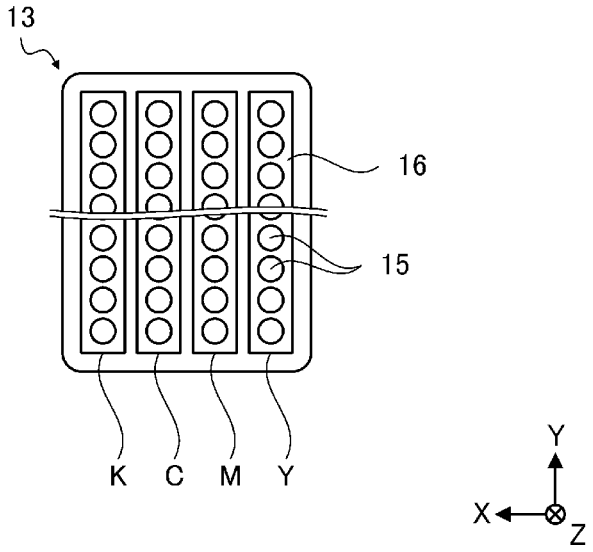
FIG. 3 is a schematic view illustrating an example of a layout of nozzles as viewed from a bottom surface of a head.

As illustrated in FIG. 3, the head 13 includes four nozzle lines 16 in which a plurality of nozzles 15 for discharging ink of respective colors are disposed side by side. More specifically, the four nozzle lines 16 include a black ink nozzle line K, a cyan ink nozzle line C, a magenta ink nozzle line M, and a yellow ink nozzle line Y. The nozzle lines 16 are aligned parallel to each other at a predetermined interval in the scanning direction.

The ink supply unit 12 includes an ink tank, an ink supply path that supplies ink from the ink tank to the head 13 and the like. Illustration of the ink tank and the ink supply path is omitted.

The ink tank, the ink supply path, and an ink supply path to nozzles 15 that discharge the same ink are independently provided for each ink.

Note that the ink is not limited to the above-mentioned ink of four colors. For example, it is possible to configure a head for handling eight colors using an eight-color ink set additionally including an ink set of light cyan, light magenta, light yellow, and light black with lighter concentrations of the respective color materials.

The movement unit 20, i.e., the scanning unit 40 and the conveyance unit 50 move the printing medium 5 relative to the head 13 under the control of the printing control unit 30.

The guide shaft 42 extends in the X-axis direction and supports the carriage 41 in a slidable manner. In addition, the carriage motor serves as a driving source when moving the carriage 41 back and forth along the guide shaft 42. That is, the scanning unit 40 moves the carriage 41, i.e., the head 13, in the X-axis direction along the guide shaft 42 under the control of the printing control unit 30. When the head 13 provided in the head unit 11 mounted in the carriage 41 discharges ink drops to the printing medium 5 supported by the platen 55 while moving in the X-axis direction under the control of the printing control unit 30, a plurality of dot lines along the X-axis direction is formed on the printing medium 5.

Note that in the present embodiment, the image control unit 111 and the printing control unit 30 constitute a control unit 60 that performs printing by controlling the head 13 and the movement unit 20 on the basis of the image data.

The supply unit 51 rotatably supports a reel on which the printing medium 5 is wound in a roll shape, and sends out the printing medium 5 to the conveyance path. The housing unit 52 rotatably supports a reel that winds up the printing medium 5, and winds up the printing medium 5 for which printing has been completed from the conveyance path.

The conveyance roller 53 is composed of a driving roller that moves the printing medium 5, a driven roller that rotates along with the movement of the printing medium 5 and/or the like, and the conveyance roller 53 moves the printing medium 5 in the Y-axis direction as the conveyance direction that intersects the scanning direction at the top surface of the platen 55. The conveyance roller 53 constitutes a conveyance path along which the printing medium 5 is conveyed from the supply unit 51 to the housing unit 52 through the printing region of the ink application unit 10. The printing region is a region where the head 13 moves in the X-axis direction at the top surface of the platen 55.

The platen 55 is a flat plate extending in the X-Y plane direction and supports the printing medium 5 in the printing region. The platen 55 is provided in such a manner that a distance PG to the head 13 can be changed in accordance with the thickness of the printing medium 5.

The printing control unit 30 includes an intra-device interface 31, a CPU 32, a memory 33, a drive control unit 34 and the like, and controls the printing unit 100.

The intra-device interface 31 is connected to the intra-device interface 119 of the image processing unit 110, and exchanges data between the image processing unit 110 and the printing unit 100.

The CPU 32 is a computation processing device for generally controlling the printing unit 100.

The memory 33 is a storage medium that secures a region for storing the program to be executed by the CPU 32, a working region of an operation and the like, and is composed of a memory element such as RAM and EEPROM.

The CPU 32 controls the ink application unit 10 and the movement unit 20 through the drive control unit 34 in accordance with a program stored in the memory 33 and printing data received from the image processing unit 110.

The drive control unit 34 includes firmware that operates under the control of the CPU 32, and controls the driving of the head unit 11 and the ink supply unit 12 of the ink application unit 10, the scanning unit 40 of the movement unit 20, and the conveyance unit 50. The drive control unit 34 is composed of a drive control circuit including a movement control signal generation circuit 35, a discharge control signal generation circuit 36, a drive signal generation circuit 37 and the like, a ROM and/or a flash memory with built-in firmware that controls the drive control circuits, and the like. Illustration of the ROM and/or the flash memory with the built-in firmware that controls the drive control circuits is omitted. Here, ROM stands for Read-Only Memory.

The movement control signal generation circuit 35 is a circuit that generates a signal for controlling the scanning unit 40 and/or the conveyance unit 50 of the movement unit 20 under a request of the CPU 32 and on the basis of the printing data.

The discharge control signal generation circuit 36 is a circuit that generates a head control signal for selection of the nozzles 15 for discharging ink, selection of the discharge amount, control of the discharge timing and the like, under a request of the CPU 32 and on the basis of the printing data.

The drive signal generation circuit 37 is a circuit that generates a drive signal for driving a pressure generation chamber provided in the head 13.

With the above-mentioned configuration, the printing control unit 30 performs printing of a desired image on the printing medium 5 supplied by the supply unit 51 and the conveyance roller 53 to the printing region by repeating an operation of discharging ink drops from the head 13 to the printing medium 5 while moving the carriage 41 supporting the head 13 in the X-axis direction along the guide shaft 42, and an operation of moving the printing medium 5 by the conveyance roller 53 in the +Y direction, which intersects the X-axis direction.

The printing onto the printing medium 5 is started when printing data is transmitted from the image processing unit 110 to the printing unit 100. The printing data is generated by the printer driver.

Figure 4:
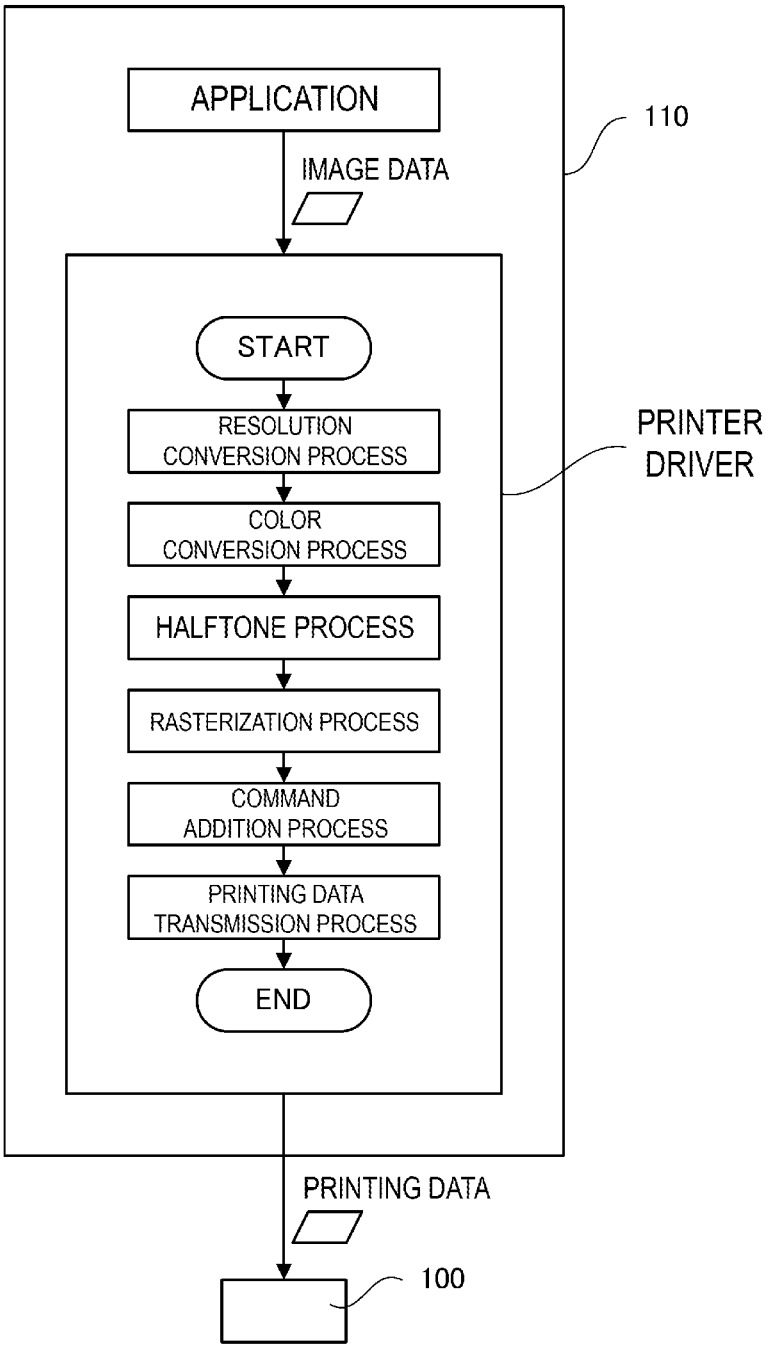
FIG. 4 is an explanatory view of a basic function of a printer driver.

A process of generating printing data performed by the printer driver is described below with reference to FIG. 4.

The printer driver receives image data from the image processing application, converts it into printing data of a format that can be interpreted by the printing unit 100, and outputs the printing data to the printing unit 100. When converting the image data from the image processing application into printing data, the printer driver performs a resolution conversion process, a color conversion process, a halftone process, a rasterization process, a command addition process, and the like.

Note that the step of receiving image data from the image processing application when the printer driver performs the process of generating printing data is the step of acquiring image data in the present embodiment.

The resolution conversion process is a process of converting the image data output from the image processing application into the resolution for printing on the printing medium 5. For example, in the case where the resolution of the printing is designated as 720×720 dpi, the image data of the vector format received from the image processing application is converted into image data of a bit map format of a resolution of 720×720 dpi. The pixel data of the image data after the resolution conversion process is composed of pixels arranged in a matrix. Each pixel has a gradation value of, for example, 256 levels of RGB color space. That is, the pixel data after resolution conversion represents the gradation value of a corresponding pixel. In the following description, the gradation value data of RGB color space is referred to as RGB data.

The pixel data corresponding to pixels of one row arranged in a predetermined direction in pixels disposed in a matrix is referred to as raster data. Note that the predetermined direction in which pixels corresponding to the raster data are arranged corresponds to the movement direction of the head 13 in printing of an image, or more specifically, the X-axis direction. That is, the movement direction of the head 13 is a relative movement direction in which the head 13 and the printing medium 5 move relative to each other.

The color conversion process is a process of converting the RGB data of image data into gradation value data of the CMYK color space. The CMYK color is cyan, magenta, yellow, and black, and image data of the CMYK color space is data corresponding to the colors of the inks provided in the printing unit 100. Accordingly, for example, in the case where the printing unit 100 uses four types of inks of the CMYK color system, the printer driver generates image data of a four-dimensional space of the CMYK color system on the basis of the RGB data. That is, the gradation value data of the CMYK color space is ink amount data. In the following description, the gradation value data of the CMYK color space is referred to as CMYK data.

This color conversion process is performed based on a color conversion look-up table that maps the gradation value of the RGB data and the gradation value of the CMYK data. Note that the pixel data after the color conversion process is 256-level CMYK data represented by the CMYK color space. In the present embodiment, the step of performing the color conversion process is an ink amount data generation step of generating ink amount data on the basis of the acquired image data.

The halftone process is a process of converting data of a high gradation level, such as data of 256 levels, into data of a gradation level that can be formed by the printing unit 100. Through this halftone process, data representing 256 levels is converted into 1-bit halftone data representing two gradation levels of dots and non-dots, and/or 2-bit halftone data representing four gradation levels of non-dots, small dots, medium dots, and large dots, for example. More specifically, a dot generation ratio corresponding to the gradation value is obtained from a dot generation ratio table that maps the gradation values of 0 to 255 and the dot generation ratios. For a dot generation ratio obtained in association with a gradation value, the generation ratio of each of non-dots, small dots, medium dots, and large dots is obtained in the case of four gradation levels, for example. Pixel data is created such that dots are formed in a dispersed manner by utilizing the dithering method, the error diffusion method, and the like at the obtained generation ratios.

The rasterization process is a process of rearranging the above-described 1-bit or 2-bit pixel data arranged in a matrix in the dot formation order in the printing. The rasterization process includes a path allocation process of allocating image data composed of the pixel data after the halftone process to each path where the head 13 discharges ink drops while moving. When the path allocation is completed, the actual nozzles 15 that form each raster line constituting a printing image are allocated. Here, the printing image means an image printed on the printing medium 5, or an image of a picture printed on the printing medium 5.

The command addition process is a process of adding, to the data having been subjected to the rasterization process, command data corresponding to the printing system. Examples of the command data include conveyance data related to the conveyance specifications of the printing medium 5. Here, conveyance specifications means, for example, the movement amount and speed of the printing medium 5 in the conveyance direction at the top surface of the platen 55.

The series of processes of the printer driver are performed by the ASIC 116 and the DSP 117 under the control of the CPU 115, and in the printing data transmission process, the printing data generated through the series of processes is transmitted to the printing unit 100 through the intra-device interface 119.

Figure 5:
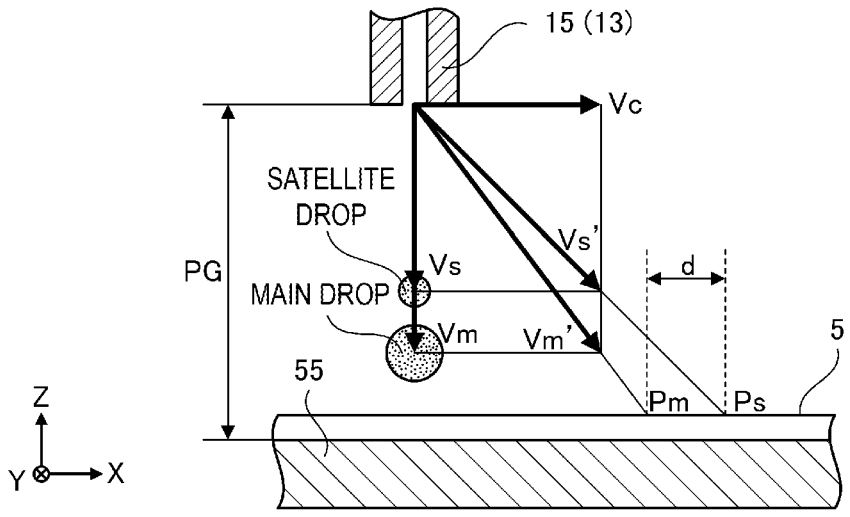
FIG. 5 is a conceptual view for describing a flying state of a discharged ink drop.

Next, a flying state of ink drops discharged from the nozzle 15 will be described with reference to FIG. 5. The printing medium 5 is placed on the top surface of the platen 55 extending in the X-Y plane direction. The opening surface of the nozzle 15 provided in the head 13 is located at the distance PG from the top surface of the platen 55 in the +Z direction. The nozzle 15 discharges ink drops in the −Z direction while moving back and forth in the X-axis direction. FIG. 5 illustrates a state where the nozzle 15 is moving in the +X direction at a speed Vc.

As illustrated in FIG. 5, an ink drop discharged from the nozzle 15 may split into a main drop and one or more satellite drops after the discharge. The flying speeds of the main drop and the satellite drop are different from each other, and Vm>Vs holds where Vm is the flying speed of the main drop, and Vs is the flying speed of the satellite drop. In addition, the nozzle 15 is moving in the X direction at the speed Vc, and accordingly the actual velocity vectors of the actual main drop and the satellite drop are Vm' and Vs'. As a result, the positions where the main drop and the satellite drop impinge on the printing medium 5 are Pm and Ps, with a deviation d.

Figure 6:
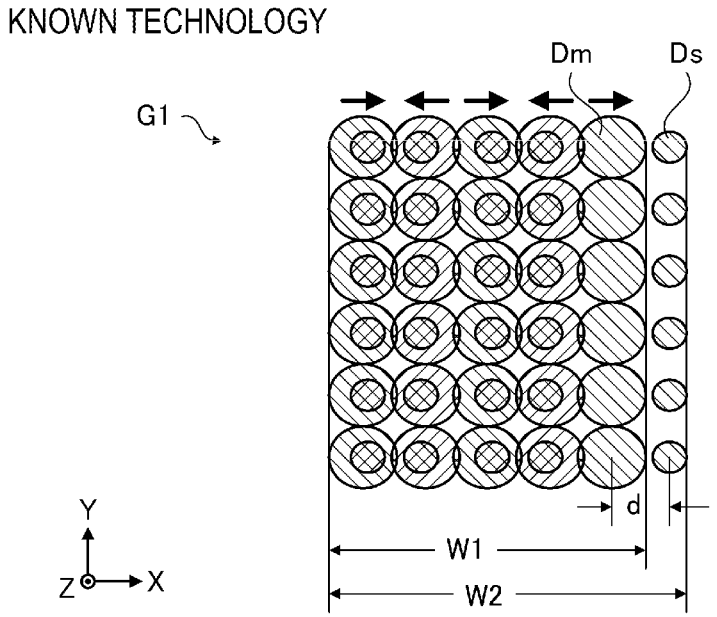
FIG. 6 is a conceptual view illustrating an example of a printing image in known technology in a case where impinging positions of a main drop and a satellite drop are shifted.

The example of the printing image illustrated in FIG. 6 illustrates an end portion of one bar G1 of a bar code extending in the Y-axis direction printed by a known technology. An ink-jet printer of a serial head type can perform the printing with higher quality by performing printing with an increased number of path operations for a predetermined region of the printing medium 5. The printing image illustrated in FIG. 6 illustrates a case where printing is performed through two path operations.

Here, the −X side is defined as one side in the scanning direction, and the +X side is defined as the other side in the scanning direction.

The bar G1 is composed of five dot lines aligned in the X-axis direction, each of which is aligned in the Y-axis direction. FIG. 6 illustrates a main dot Dm formed by the main drop, and a satellite dot Ds formed by one separated satellite drop.

As illustrated in FIG. 6 with arrows, the odd-numbered dot lines from one end of the bar G1, i.e., the −X side end, are printed through a path operation of a first scan in which the head 13 is moved in the +X direction, and the even-numbered dot lines from the −X side end are printed through a path operation of a second scan in which the head 13 is moved in the −X direction.

The satellite drop impinges with the deviation d with respect to the main drop in the movement direction of the head 13. Accordingly, the satellite drop of the dot line on the +X side end printed by the first scan in which movement is performed in the +X direction impinges on the outside of the five dot lines constituting the bar G1 in the +X direction. As a result, as illustrated in FIG. 6, the bar width of the bar G1, which should have a width W1, is a width W2 greater than the width W1 because of the satellite dot Ds.

Figure 7:
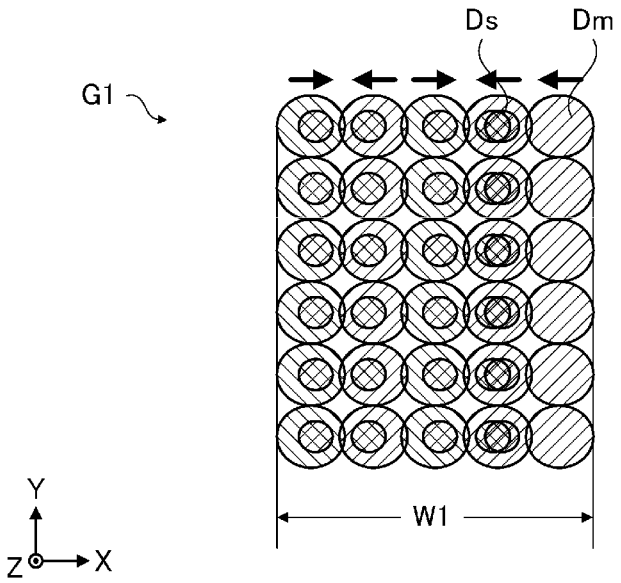
FIG. 7 is a conceptual view illustrating an example of a printing image printed by the printing apparatus and a printing method according to the embodiment.

In contrast, in the printing apparatus 1 of the present embodiment, the dot line on the +X side end is printed in the second scan in which movement is performed in the −X direction, as illustrated in FIG. 7. That is, when performing printing of the other end portion of the printing image, the control unit 60 performs the printing by the second scan in which the head 13 is moved from the other side to the one side. In such printing, the satellite drop of the dot line on the +X side end impinges within the five dot lines constituting the bar G1, and the bar G1 is printed with the predetermined width W1.

Note that as a result of the printing of the dot line on the +X side end in the second scan in which movement is performed in the −X direction, two consecutive dot lines are printed in the second scan. Preferably, the printing of the two dot lines is performed in the same path operation, but in the case where continuous discharge of ink from the head 13 is not possible in time for the movement speed of the carriage 41, the printing is performed in the path operation of the next second scan in which movement is performed in the −X direction.

Likewise, in the case where the odd-numbered dot lines from the end on the −X side of the bar G1 are printed in the second scan, and the even-numbered dot lines from the end on the −X side are printed in the first scan in a direction opposite to that of the example illustrated in FIG. 6, the satellite drop of the dot line on the −X side end printed in the second scan in which movement is performed in the −X direction impinges on the outside of the five dot lines constituting the bar G1 in the −X direction. In this case, in the printing apparatus 1 of the present embodiment, the dot line on the −X side end is printed in the first scan in which movement is performed in the +X direction. That is, when performing printing of one end portion of the printing image, the control unit 60 performs printing by the first scan in which the head 13 is moved from one side to the other side.

More specifically, such a control of the control unit 60 can be performed in the path allocation in the above-described rasterization process. In the rasterization process, the image control unit 111 performs analysis of the printing image, or more specifically, analysis of the image data, and performs path allocation such that printing is performed by the first scan in which the head 13 is moved from one side to the other side when printing of one end portion of the printing image such as a bar code, a line drawing, or a text is performed, and that printing is performed by the second scan in which the head 13 is moved from the other side to the one side when printing of the other end portion of the printing image is performed.

That is, when viewed as a printing method of printing a printing image in the printing apparatus 1 including the head 13 that discharges an ink to the printing medium 5 and the carriage 41 that moves the head 13 back and forth to one side and the other side in the scanning direction with respect to the printing medium 5, a feature of the printing method of the present embodiment is that printing is performed by the first scan in which the head 13 is moved from one side to the other side when printing of one end portion of the printing image is performed, and printing is performed by the second scan in which the head 13 is moved from the other side to the one side when printing of the other end portion of the printing image is performed.

Incidentally, as can be seen in FIG. 5, the deviation d of impinging positions of the main drop and the satellite drop differs depending on the main drop discharged from the head 13, the flying speed of the satellite drop, the distance from the head 13 to the printing medium 5, the movement speed of the head 13, and the like.

A flying speed Vm of the main drop, i.e., the discharge speed of the main drop, can be controlled by the drive signal generated by the drive signal generation circuit 37. In addition, the distance from the head 13 to the printing medium 5 is determined by the thickness of the printing medium 5, and the distance PG from the head 13 to the platen 55 that is set in accordance with the thickness of the printing medium 5. In addition, the movement speed of the head 13 can be controlled by the drive signal of the carriage motor generated by the movement control signal generation circuit 35.

In addition, the acceptable range of the deviation of the impinging position of the satellite drop differs depending on the specification of the printing image and the user's judgement.

In view of this, the printing apparatus 1 is configured to execute the printing method of a feature of the present embodiment when required. More specifically, in a case of a predetermined state based on information of at least one of the flying distance of the ink drop from the head 13 to the printing medium 5, the flying time of the ink drop from the head 13 to the printing medium 5, the thickness of the printing medium 5, the discharge speed of the ink drop discharged by the head 13, the movement speed of the carriage 41, and a request input to the control unit 60, the control unit 60 performs the printing by the first scan when performing printing of one end portion of the printing image, and performs the printing by the second scan when performing printing of the other end portion of the printing image.

Here, the predetermined state is a state where printing should be performed by the printing method of a feature of the present embodiment, that is, a state where the deviation of the impinging position of the satellite drop would be determined to be unacceptable in printing using known technology. This predetermined state is a state that is determined based on a parameter such as the flying distance of the ink drop from the head 13 to the printing medium 5, the flying time of the ink drop from the head 13 to the printing medium 5, the thickness of the printing medium 5, the flying speed of the ink drop, and the movement speed of the carriage 41, and is therefore set by performing sufficient evaluation in advance in accordance with the printing quality of the desired printing image such as a bar code of a predetermined standard, for example. More specifically, in the control unit 60, when determining that the state is a predetermined state set in advance with reference to each parameter through the function of the printer driver in generation of printing data, the image control unit 111 generates printing data for executing a control in which the printing is performed by the first scan when performing printing of one end portion of the printing image, and the printing is performed by the second scan when performing printing of the other end portion of the printing image.

Note that even when the image control unit 111 determines that the state is a predetermined state set in advance with reference to each parameter, the printing of the printing method of a feature of the present embodiment may be determined to be not performed based on the user's judgement. In addition, conversely, even when the image control unit 111 determines that the state is not the predetermined state set in advance with reference to each parameter, the printing of the printing method of a feature of the present embodiment may be desired to be executed based on the user's judgement.

The printing apparatus 1 is configured to be able to receive a request of the user in priority to the determination of the image control unit 111. More specifically, in the function of the printer driver, the image control unit 111 receives an input of a request of the user from the input unit 112, and generates printing data based on the input request.

FIG. 5 and FIG. 6 illustrate a case where a discharged ink drop is split into the main drop and one satellite drop in printing using known technology. In addition, FIG. 6 illustrates an example case where the satellite drop does not deviate beyond the impinging position of the adjacent main drop. However, depending on the driving specification of the head 13 and/or the moving speed of the carriage 41, two or more satellite drops may be generated, or the satellite drop may impinge at a position shifted beyond the impinging position of the adjacent main drop.

More specifically, the higher the movement speed of the carriage 41, the greater the number of the separated satellite drops, and the greater the degree of deviation of the impinging position of the separated satellite drops tends to be. In addition, the greater the distance from the head 13 to the printing medium 5, the greater the number of the separated satellite drops, and the greater the degree of deviation of the impinging position of the separated satellite drops tends to be. Specifically, depending on the movement speed of the carriage 41 and/or the distance from the head 13 to the printing medium 5, satellite drops separated from the main drop discharged to a position inside the position of the main dot Dm forming the endmost portion of the printing image may impinge outside the printing image beyond the position of the main dot Dm forming the endmost portion.

Figure 8:
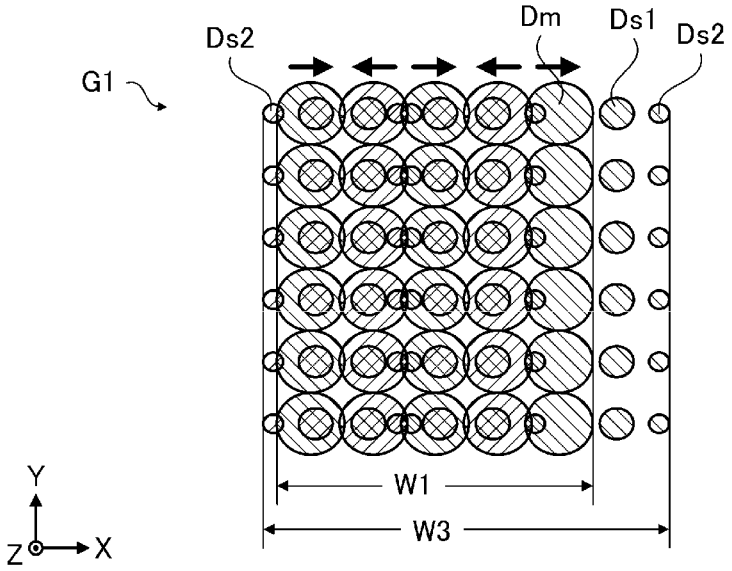
FIG. 8 is another conceptual view illustrating an example of a printing image in known technology in a case where impinging positions of a main drop and a satellite drop are shifted.

Details are described below with reference to FIG. 8. FIG. 8 illustrates an impinging state of the main dot Dm formed by the main drop, and satellite dots Ds1 and Ds2 formed by two separated satellite drops in printing using known technology. The satellite dot Ds2 is further separated from the main dot Dm than the satellite dot Ds1, and is formed beyond the impinging position of the main drop adjacent thereto in the scanning movement direction of the head 13, i.e., a position beyond the main dot Dm adjacent thereto in the scanning direction. The dots not only impinge on a further separated position outside the five dot lines constituting the bar G1 in the +X direction, but also on a position outside the bar G1 in the −X direction. As a result, the bar width of the bar G1, which should be configured with the width W1, is a width W3 further greater than the width W2 illustrated in FIG. 6.

Figure 9:
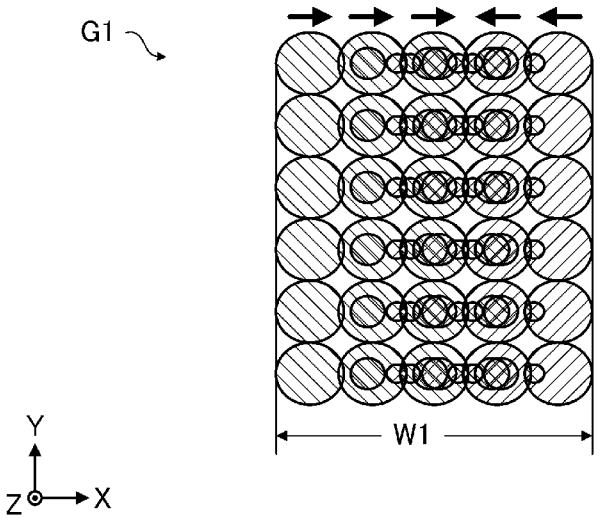
FIG. 9 is a conceptual view illustrating another example of a printing image printed by the printing apparatus and the printing method according to the embodiment.

In view of such a printing, in the printing apparatus 1, the second dot line from the −X side end that is printed in the second scan in which movement is performed in the −X direction is printed in the first scan in which movement is performed in the +X direction as illustrated in FIG. 9. In addition, the dot line of the +X side end that is printed in the first scan in which movement is performed in the +X direction is printed in the second scan in which movement is performed in the −X direction. In addition, the dot line on the +X side end that is printed in the first scan in which movement is performed in the +X direction is printed in the second scan in which movement is performed in the −X direction.

The range of the position of the main dot Dm formed by the main drop generating the satellite drops that impinge on the outside of the printing image formed by the main dot Dm, i.e., the range of the printing image for which the scan of discharging the main drop generating the satellite drops that impinge on the outside of the printing image formed by the main dot Dm in the known technology is set to a scan in the direction in which the satellite drops impinge on the inside of the printing image, depends on the value of the deviation d of the impinging positions of the main drop and the satellite drops. As described above, the value of the deviation d of the impinging positions of the main drop and the satellite drop varies depending on the main drop discharged from the head 13, the flying speed of the satellite drops, the distance from the head 13 to the printing medium 5, the movement speed of the head 13, and the like.

In view of this, in the printing apparatus 1, the range of the target main dot Dm of one end portion of the printing image to be printed in the first scan and the range of the target main dot Dm of the other end portion of the printing image to be printed in the second scan are set based on the information of at least one of the flying distance of the ink drop from the head 13 to the printing medium 5, the flying time of the ink drop from the head 13 to the printing medium 5, the thickness of the printing medium 5, the flying speed of the ink drop, and the movement speed of the carriage 41.

Here, in other words, the range of the target main dot Dm of one end portion of the printing image to be printed in the first scan is a minimum length, in the scanning direction, of one end portion of the printing image that is to be printed in the first scan. In addition, in other words, the range of the target main dot Dm of the other end portion of the printing image to be printed in the second scan is a minimum length, in the scanning direction, of the other end portion of the printing image that is to be printed in the second scan.

More specifically, the printing apparatus 1 sets the length, in the scanning direction, of one end portion of the printing image that is to be printed in the first scan and the length, in the scanning direction, of the other end portion of the printing image that is to be printed in the second scan such that the higher the set movement speed of the carriage 41, the greater the lengths.

In addition, the printing apparatus 1 sets the length, in the scanning direction, of one end portion of the printing image that is to be printed in the first scan and the length, in the scanning direction, of the other end portion of the printing image that is to be printed in the second scan such that the greater at least one of the set distance from the head 13 to the printing medium 5, and the set distance from the head 13 to the platen 55 that supports the printing medium 5, the greater the lengths.

The minimum lengths in the scanning direction of the end portions of the printing image to be printed in the first scan and the second scan are set by performing sufficient evaluation in advance in accordance with the printing quality of the desired printing image such as a bar code of a predetermined standard, for example. More specifically, in the control unit 60, with reference to each parameter through the function of the printer driver in generation of printing data, the image control unit 111 generates printing data for executing a control in which the printing is performed by the first scan for a predetermined length set in advance when performing printing of one end portion of the printing image, and the printing is performed by the second scan for a predetermined length set in advance when performing printing of the other end portion of the printing image.

Note that as described above, the acceptable range of the deviation of the impinging position of the satellite drop varies depending on the specification of the printing image and the user's judgement. In view of this, a minimum length, in the scanning direction, of one end portion of the printing image that is to be printed in the first scan, and a minimum length, in the scanning direction, of the other end portion of the printing image that is to be printed in the second scan may be configured to be set based on the information of a request input to the control unit 60.

With the printing apparatus and the printing method of the present embodiment, the following effects can be achieved.

The ink discharged by the head 13 may be split into the main drop and one or more satellite drops following the main drop at the time when or immediately after it is discharged. The impinging of the satellite drop is delayed compared to the impinging of the main drop, and consequently the impinging positions are shifted in the scanning direction. In view of this, in the printing apparatus 1 of the present embodiment, the printing is performed by the first scan in which the head 13 is moved from one side to the other side when printing of one end portion of the printing image is performed, and the printing is performed by the second scan in which the head 13 is moved from the other side to the one side when printing of the other end portion of the printing image is performed. In this manner, the satellite drops impinge in a direction inward of the end portions of the desired printing image, and it is thus possible to suppress an increase in the distance from one end portion to the other end portion of the printing image and the distortion of the printing image due to a change in the direction of the increasing distance due to the influence of the satellite drops. That is, for example, it is possible to suppress an increase in the thickness of a bar of a bar code and distortion of the shape of the bar.

In addition, the degree of deviation of the impinging position of the separated discharged ink varies depending on the difference in parameters such as the discharge speed of the ink discharged by the head 13 and the movement speed of the carriage 41, the distance from the head 13 to the platen 55 that supports the printing medium 5, the distance from the head 13 to the printing medium 5 that varies depending on the thickness of the printing medium 5, and parameters such as the flying distance and flying time of the ink from the head 13 to the printing medium 5. In addition, the degree of the printing quality required for the printing image differs depending on the purpose and use.

According to the present embodiment, the control unit 60 performs printing by the first scan in which the head 13 is moved from one side to the other side when printing of one end portion of the printing image is performed, and performs printing by the second scan in which the head 13 is moved from the other side to the one side when printing of the other end portion of the printing image is performed in a case of a predetermined state based on information of at least one of the flying distance of the ink from the head 13 to the printing medium 5, the flying time of the ink from the head 13 to the printing medium 5, the thickness of the printing medium 5, the discharge speed of the ink discharged by the head 13, the movement speed of the carriage 41, and a request input to the control unit 60. Accordingly, by appropriately setting the predetermined state based on the above-mentioned parameters related to the degree of deviation of the impinging position of the separated discharged ink, more effective and efficient printing with the desired print quality can be performed.

In addition, according to the present embodiment, the minimum length, in the scanning direction, of one end portion of the printing image that is to be printed by the first scan in which the head 13 is moved from one side to the other side, and the minimum length, in the scanning direction, of the other end portion of the printing image that is to be printed by the second scan in which the head 13 is moved from the other side to the one side are set based on information of at least one of the flying distance of the ink from the head 13 to the printing medium 5, the flying time of the ink from the head 13 to the printing medium 5, the thickness of the printing medium 5, the flying speed of the ink, the movement speed of the carriage 41, and a request input to the control unit 60. That is, the range for suppressing the influence of the deviation of the impinging position is set in accordance with the degree of deviation of the impinging position of the separated discharged ink and the desired printing quality, and thus more effective and efficient printing with the desired print quality can be performed.

In addition, the higher the movement speed of the carriage 41, the greater the degree of deviation of the impinging position of the separated discharged ink tends to be. In addition, the higher the movement speed of the carriage 41, the greater the degree of deviation of the impinging position of the separated discharged ink tends to be.

According to the present embodiment, the higher the set movement speed of the carriage 41, the greater the length, in the scanning direction, of one end portion of the printing image that is to be printed by the first scan in which the head 13 is moved from one side to the other side and the length, in the scanning direction, of the other end portion of the printing image that is to be printed by the second scan in which the head 13 is moved from the other side to the one side. That is, the length of the end portion in the scanning direction to be printed with the impinging on the inside of the end portion of the image increases as the set movement speed of the carriage 41 increases, and thus impinging of satellite drops outside the end portion of the desired printing image is suppressed.

In addition, the greater the distance from the head 13 to the printing medium 5, the greater the degree of deviation of the impinging position of the separated discharged ink tends to be. That is, depending on the distance from the head 13 to the printing medium 5, the satellite drop separated from the main drop discharged to the inside of the endmost portion of the printing image may go beyond the endmost portion of the printing image and impinge on the outside of the desired printing image.

According to the present embodiment, the greater at least one of the set distance from the head 13 to the printing medium 5 and the set distance from the head 13 to the platen 55 that supports the printing medium 5, the greater the length, in the scanning direction, of one end portion of the printing image that is to be printed by the first scan in which the head 13 is moved from one side to the other side and the length, in the scanning direction, of the other end portion of the printing image that is to be printed by the second scan in which the head 13 is moved from the other side to the one side. That is, the length of the end portion in the scanning direction to be printed with the impinging on the inside of the end portion of the image increases as at least one of the set distance from the head 13 to the printing medium 5 and the set distance from the head 13 to the platen 55 that supports the printing medium 5 increases, and thus impinging of the satellite drop outside the end portion of the desired printing image is suppressed.

Note that in the above-described embodiment, when generating printing data, the image control unit 111 performs path allocation in the rasterization process such that the printing is performed by the first scan when performing printing of one end portion of the printing image, and the printing is performed by the second scan when performing printing of the other end portion of the printing image control executed. Here, for example, when printing a printing image G2 such as that illustrated in FIG. 10 by known technology, the image control unit 111 may generate printing data such that the printing image G2 is shifted by one dot in the scanning direction as illustrated in FIG. 11.

Figure 10:
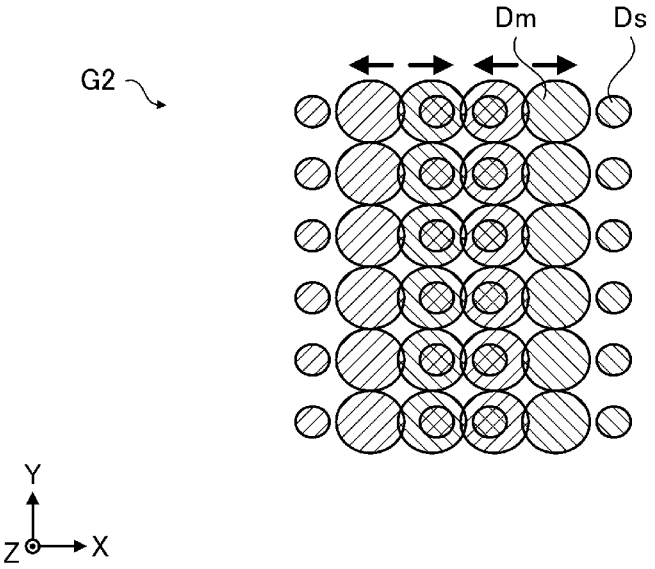
FIG. 10 is still another conceptual view illustrating an example of a printing image in known technology in a case where impinging positions of a main drop and a satellite drop are shifted.
Figure 11:
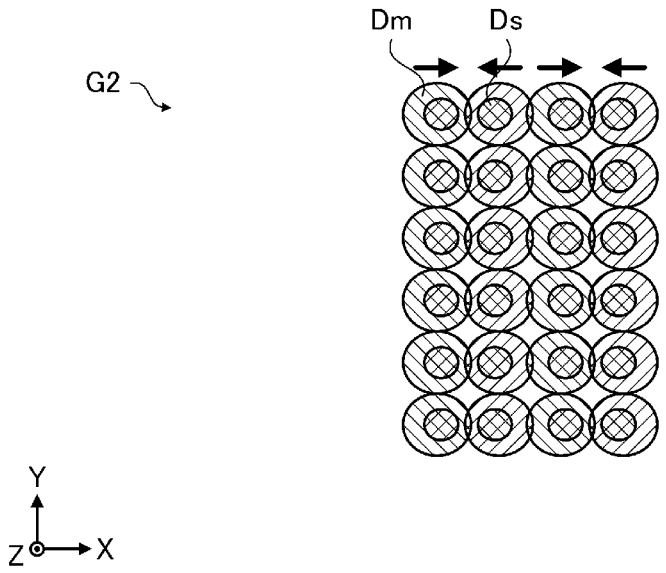
FIG. 11 is a conceptual view illustrating still another example of a printing image printed by the printing apparatus and the printing method according to the embodiment.

Here, the printing image G2 such as that illustrated in FIG. 10 is a printing image in which dot lines whose scanning direction is alternately changed are alternately arranged, and formed such that the satellite dot Ds of the dot lines of both ends is shifted to the outside of the printing image G2. By shifting the printing image G2 by one dot in the scanning direction, the satellite drop that would otherwise impinge on the outside of the printing image G2 impinges on the inside of the printing image G2, as illustrated in FIG. 11.

What is claimed is:

1. A printing apparatus comprising:

a head configured to discharge liquid to a printing medium;

a carriage configured to move the head back and forth to one side and another side in a scanning direction with respect to the printing medium; and a control unit configured to perform printing of a printing image with the liquid by controlling driving of the head and the carriage, wherein in a predetermined state based on information of at least one of a flying distance of the liquid from the head to the printing medium, a flying time of the liquid from the head to the printing medium, a thickness of the printing medium, a discharge speed of the liquid discharged from the head, a movement speed of the carriage, and a request input by a user to the control unit, when performing printing of an end portion of the printing image on the one side, the control unit performs the printing by a first scan in which the head is moved from the one side to the other side, and when performing printing of an end portion of the printing image on the other side, the control unit performs the printing by a second scan in which the head is moved from the other side to the one side, and wherein the control unit is configured to, for the information of the predetermined state in which the control unit performs the printing by the first scan and the printing by the second scan, prioritize the request input by the user over the flying distance of the liquid from the head to the printing medium, the flying time of the liquid from the head to the printing medium, the thickness of the printing medium, the discharge speed of the liquid discharged from the head, and the movement speed of the carriage.

2. The printing apparatus according to claim 1, wherein a minimum length, in the scanning direction, of the end portion of the printing image on the one side that is to be printed by the first scan, and a minimum length, in the scanning direction, of the end portion of the printing image on the other side that is to be printed by the second scan, is set based on information of at least one of the flying distance of the liquid from the head to the printing medium, the flying time of the liquid from the head to the printing medium, the thickness of the printing medium, a flying speed of the liquid, the movement speed of the carriage, and the request input to the control unit.

3. The printing apparatus according to claim 1, wherein the higher a set movement speed of the carriage, the greater a length, in the scanning direction, of the end portion of the printing image on the one side that is to be printed by the first scan, and a length, in the scanning direction, of the end portion of the printing image on the other side that is to be printed by the second scan.

4. The printing apparatus according to claim 1, wherein the greater at least one of a set distance from the head to the printing medium, and a set distance from the head to a platen that supports the printing medium, the greater a length, in the scanning direction, of the end portion of the printing image on the one side that is to be printed by the first scan, and a length, in the scanning direction, of the end portion of the printing image on the other side that is to be printed by the second scan.

5. A printing method of performing printing of a printing image in a printing apparatus including a head configured to discharge liquid to a printing medium, and a carriage configured to move the head back and forth to one side and another side in a scanning direction with respect to the printing medium, the method comprising:

in a predetermined state based on information of at least one of a flying distance of the liquid from the head to the printing medium, a flying time of the liquid from the head to the printing medium, a thickness of the printing medium, a discharge speed of the liquid discharged from the head, a movement speed of the carriage, and a request input by a user to the control unit, performing the printing by a first scan in which the head is moved from the one side to the other side when performing printing of an end portion of the printing image on the one side, and performing the printing by a second scan in which the head is moved from the other side to the one side when performing printing of an end portion of the printing image on the other side, for the information of the predetermined state in which the printing by the first scan and the printing by the second scan are performed, the request input by the user being prioritized over the flying distance of the liquid from the head to the printing medium, the flying time of the liquid from the head to the printing medium, the thickness of the printing medium, the discharge speed of the liquid discharged from the head, and the movement speed of the carriage.

* * * * *